US007334428B2

(12) United States Patent
Holdsworth

(10) Patent No.: US 7,334,428 B2
(45) Date of Patent: Feb. 26, 2008

(54) COOLING SYSTEM FOR A ROTARY SCREW COMPRESSOR

(75) Inventor: John Holdsworth, Michigan City, IN (US)

(73) Assignee: Sullair Corporation, Michigan City, IN (US)

( * ) Notice: Subject to any disclaimer, the term of this patent is extended or adjusted under 35 U.S.C. 154(b) by 158 days.

(21) Appl. No.: 11/239,895

(22) Filed: Sep. 30, 2005

(65) Prior Publication Data

US 2007/0074535 A1 Apr. 5, 2007

(51) Int. Cl.
*F25B 1/00* (2006.01)

(52) U.S. Cl. ..... 62/501; 62/498

(58) Field of Classification Search ..... 62/501, 62/402, 401, 498, 87
See application file for complete search history.

(56) References Cited

U.S. PATENT DOCUMENTS 3,668,884 A * 6/1972 Nebgen ..... 62/228.5
5,413,467 A 5/1995 Suzuki
5,947,711 A 9/1999 Myers
6,220,825 B1 4/2001 Myers
6,272,871 B1 8/2001 Eisenhour
6,301,922 B1 * 10/2001 Ochi ..... 62/402
6,381,973 B1 * 5/2002 Bhatti et al. ..... 62/172
6,412,291 B1 * 7/2002 Erickson ..... 62/87
6,604,378 B2 8/2003 Clodic
6,629,427 B1 * 10/2003 Piao et al. ..... 62/271
6,658,873 B2 12/2003 Clarke
6,739,119 B2 * 5/2004 Erickson ..... 60/39.53
2003/0019237 A1 1/2003 Clarke

FOREIGN PATENT DOCUMENTS

JP 2000028169 1/2000

* cited by examiner

*Primary Examiner*—Melvin Jones
(74) *Attorney, Agent, or Firm*—Carlson, Gaskey & Olds

(57) ABSTRACT

A compressor system has a compression stage, a coolant circuit and a refrigerant circuit. The compression stage compresses ambient air and generates compressed air and heat. A coolant removes heat from the compression stage and the heat is transferred from the coolant to a refrigerant. A refrigerant expansion device is incorporated into the refrigerant circuit. The expansion device expands the pressurized refrigerant utilizing a rotary expander. Energy generated during refrigerant expansion is captured and used to drive components of the cooling system.

14 Claims, 2 Drawing Sheets

COOLING SYSTEM FOR A ROTARY SCREW COMPRESSOR

BACKGROUND OF THE INVENTION

This application relates to a cooling system for a compressor, which utilizes energy generated by a fluid expansion to power at least one component.

Rotary screw compressors include one or more rotor systems having a male rotor and a female rotor, which rotate relative to each other to produce compressed air. During normal operation, the compressor system generates heat. If not reduced, the heat build-up may inhibit the efficiency of the compressor system.

Thus, a liquid coolant is communicated through the compressor. The coolant absorbs thermal energy. The heated coolant is communicated to a heat exchanger, wherein heat is transferred to the ambient air or a liquid, which is dumped to waste. Electrically powered fans typically drive airflow through the liquid-to-air heat exchanger to remove the absorbed thermal energy.

It would be desirable to utilize the thermal energy built-up in the coolant to reduce power requirements of the compressor.

SUMMARY OF THE INVENTION

A compressor system has a compression stage, a coolant circuit and a refrigerant circuit. A refrigerant expansion device is incorporated into the refrigerant circuit. Energy generated during refrigerant expansion is captured and used to drive components of the compressor system.

Ambient air enters the compression stage, and one or more compressors compress the air to a desired compression level. The compression stage generates compressed air and heat.

A coolant lubricates components of the compression stage and carries away heat from the compression stage.

Thermal energy is communicated from the coolant to a refrigerant. In addition, compressed air within the compression stage communicates thermal energy to the refrigerant, which increases the pressure of the refrigerant. The expansion device then expands the pressurized refrigerant utilizing a rotary expander. The expansion of the pressurized refrigerant generates a rotational output, which is used to drive a compressor component.

These and other features of the present invention can be best understood from the following specification and drawings, the following of which is a brief description.

DETAILED DESCRIPTION OF THE PREFERRED EMBODIMENT

Figure 1:
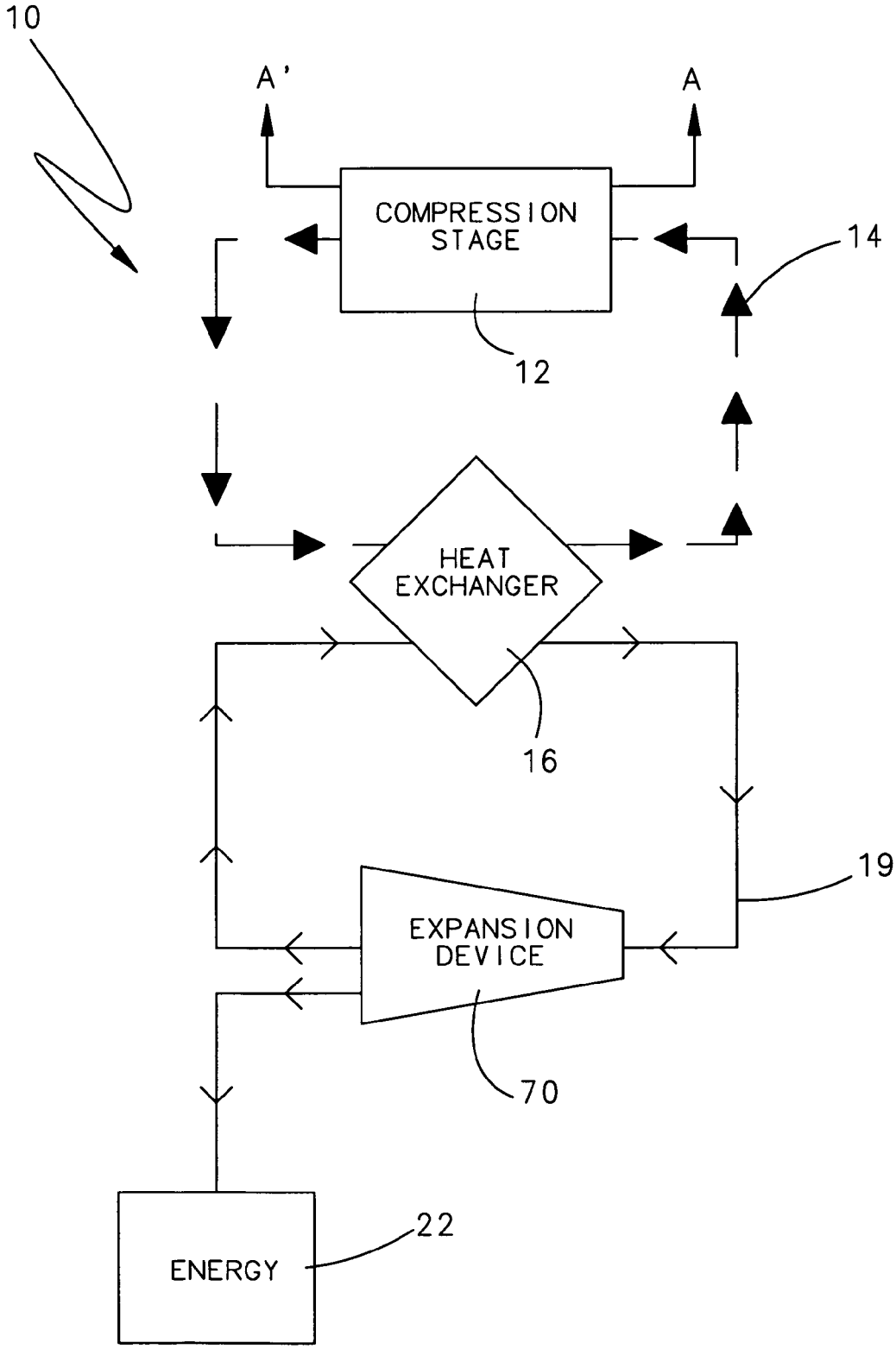
FIG. 1 is a schematic representation of the screw compressor cooling system according to the current invention.

FIG. 1 illustrates a general schematic view of a screw compressor system 10 having a compression stage 12, a heat exchanger 16, and a refrigerant expansion device 20. The system 10 uses thermal energy generated during the compression stage 12 to drive at least one component of the screw compressor cooling system 10.

Ambient air A enters the compression stage 12 where one or more screw compressors compress the ambient air A to a desired compression level A'. A coolant, which may be oil, lubricates components of the compression stage 12 and fluidly communicates thermal energy from the compression stage 12 to the heat exchanger 16. The coolant communicates with the compression stage 12 and the heat exchanger 16 through a coolant circuit 14.

Within the heat exchanger 16, heat is communicated from the coolant to a refrigerant. In addition, compressed air A' within the compression stage 12 may communicate heat to the refrigerant which increases the pressure of the refrigerant. An expansion device 20 expands the pressurized refrigerant. Energy 22 from this expansion is captured to drive components of the screw compressor cooling system 10. The refrigerant communicates with the heat exchanger 16 and the expansion device 20 through a refrigerant circuit 19.

Figure 2:
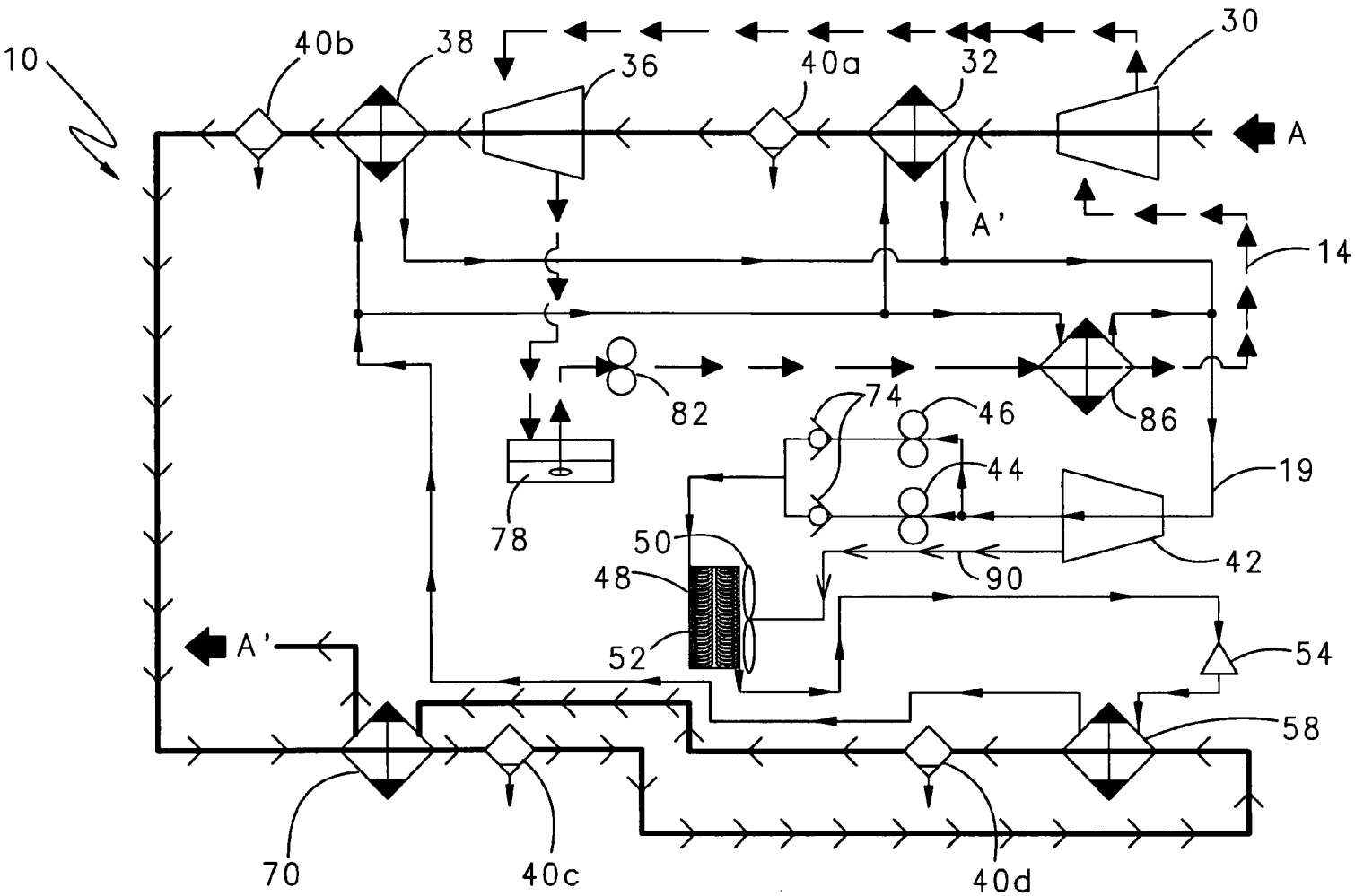
FIG. 2 is a detailed schematic representation of the current invention.

Referring to FIG. 2, ambient air A enters a first-stage compressor 30 whereupon screw-type rotors within the first-stage compressor 30 generate compressed air A'. The coolant in coolant circuit 14 communicates through the first-stage compressor 30 lubricating and removing the heat of compression. Compressed air A' communicates from the first-stage compressor 30 to an intercooler 32, which is preferably a shell-and-tube type heat exchanger having compressed air A' in the tubes and the refrigerant in refrigerant circuit 19 in the shells. The intercooler 32 cools the compressed air A', transferring heat from the compressed air A' to the refrigerant.

Cooling compressed air A' may generate condensate or other effluent; accordingly, compressed air A' communicates with a condensate drain 40*a* to remove the condensate. The system 10 includes additional condensate drains 40*b*, 40*c*, and 40*d*, providing multiple draining points for the effluent. Compressed air A' typically moves through the condensate drains 40*a*, 40*b*, 40*c*, and 40*d* after being cooled.

Typically, the ambient air A and compressed air A' undergo multiple compression stages to achieve the desired compression level. Compressed air A' which exits the intercooler 32 is communicated to a second-stage compressor 36. Screw type rotors within the second-stage compressor 36 further compress the compressed air A' to a desired compression level. As with the first-stage compressor 30, the second-stage compressor 36 generates thermal energy. The coolant within the coolant circuit 14 lubricates the second-stage compressor 36, again removing heat.

Compressed air A' is communicated from the second-stage compressor 36 to an aftercooler 38 to remove heat. The aftercooler 38, similar to the intercooler 32, may be a shell-and-tube heat exchanger in which refrigerant flows through the heat exchanger shells and compressed air A' flows through the heat exchanger tubes. Cooling the compressed air A' in the aftercooler 38 produces condensation. Again, the condensate drain 40*b*, in communication with the aftercooler 38, removes effluent from the aftercooler 38.

Compressed air A' is then communicated through two additional heat exchangers, a first-stage air dryer heat exchanger 70 and a second-stage air dryer heat exchanger 58. The first-stage heat exchanger 70 is an air-to-air heat exchanger having a fan for moving ambient air over the heat exchanger 70. The ambient air expedites transfer of heat from the compressed air A' to the ambient air. The second-stage heat exchanger 58 is also preferably a shell-and-tube type heat exchanger in which refrigerant flows though the heat exchanger shells and compressed air A' flows though the heat exchanger tubes. The refrigerant in the shell may be within the same circuit as the refrigerant in both the intercooler 32 and the aftercooler 38. Compressed air A' exits the system 10 after being communicated through the heat exchangers 70 and 58.

In sum, the intercooler 32, the aftercooler 38, and the second-stage air dryer heat exchanger 58 all communicate heat to the refrigerant. The refrigerant also absorbs thermal energy from the heated coolant.

Thermal energy is communicated from the coolant to the refrigerant through a coolant cooler 86. A coolant dump 78 maintains a reserve of the heated coolant from which a coolant pump 82 communicates heated coolant to the coolant cooler 86. The coolant cooler 86 exchanges heat from the heated coolant to the refrigerant.

The pressure of the refrigerant (say an R-134a refrigerant) increases as the refrigerant absorbs thermal energy. When pressurized, the refrigerant may condense into a liquid form. A rotary expander 42 expands the pressurized, and possibly liquefied, refrigerant to drive components of the system 10.

As shown, pressurized refrigerant enters the rotary expander 42 and is expanded to rotatably drive a portion of the expander. In one example, the rotary expander 42 (e.g., an ES8 airend) generates electrical power. At any rate, expanders are known which generate electrical power when driven to rotate. The electrical power is sent through line 90 to drive a condenser fan 50. Other methods of driving components utilizing a rotary expander 42 will be apparent to one of ordinary skill in the art. As an example, the rotary portion of the rotary expander 42 may directly drive the fan 50.

Once expanded, the refrigerant is communicated through a refrigerant condenser 48 to dump heat and cool the system. The condenser fan 50, electrically powered by the rotary expander 42, communicates ambient air over the refrigerant condenser 48 expediting the cooling process. Coils 52 within the refrigerant condenser 48 provide a path for the refrigerant.

The refrigerant is further expanded through an expansion valve 54 after being communicated through the refrigerant condenser 48.

Preferably, the refrigerant is driven through the system 10 relying on the heat generated by the compression stage 12. However, electrical power generated by the rotary expander 42 may additionally power a refrigerant pump 44 to communicate the refrigerant through the system 10. The refrigerant pump 44 would supplement communication of the refrigerant through the system 10.

An auxiliary pump 46, not utilizing power generated by the rotary expander 42, may additionally be utilized to drive the refrigerant. It should be understood that check valves 74 or the like prevent the refrigerant from reversing the preferred communication direction, flooding the refrigerant pump 44 and the auxiliary pump 46.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An air compressor system comprising:

a compressor for receiving and compressing a supply of air;

a lubricant circuit for delivering lubricant to said compressor to lubricate and cool components in said compressor, said lubricant moving from the compressor into a heat exchanger; and a refrigerant circuit for moving a refrigerant into said heat exchanger to cool the lubricant, refrigerant moving from said heat exchanger through a refrigerant expander, said refrigerant expander being driven by the refrigerant, and the refrigerant expander being utilized to drive a system component.

2. A method of operating a compressor system comprising:

compressing a supply of air with a compressor;

delivering lubricant to said compressor to lubricate and cool components in said compressor and moving lubricant from the compressor into a heat exchanger; and delivering refrigerant into said heat exchanger to cool the lubricant, refrigerant moving from said heat exchanger through a refrigerant expander, said refrigerant expander being driven by the refrigerant, and refrigerant expander being utilized to drive a system component.

3. The air compressor system as described in claim 1, wherein said refrigerant expander generates electrical power.

4. The air compressor system as described in claim 1, wherein said refrigerant expander drives at least one fan.

5. The air compressor system as described in claim 4, wherein said refrigerant expander electrically powers said at least one fan.

6. The air compression system as described in claim 4, wherein said at least one fan moves air over a condenser to cool said refrigerant.

7. The air compressor system as described in claim 1, wherein said refrigerant expander is a rotary expander.

8. An air compressor system comprising:

a compressor;

a coolant circuit having coolant in communication with said compressor and a heat exchanger;

a refrigerant circuit having refrigerant in communication with said heat exchanger and a refrigerant expander, wherein said refrigerant expander expands said refrigerant to drive a system component; and wherein said refrigerant expander drives a fluid pump.

9. The air compressor system as described in claim 8, wherein said fluid pump is in said refrigerant circuit.

10. The method as recited in claim 2, comprising:

e) moving fluid with said at least one component.

11. The method as recited in claim 10, wherein said fluid is air.

12. The method as recited in claim 10, wherein said fluid is said refrigerant.

13. The method as recited in claim 2, wherein said step c) includes expanding said refrigerant using a rotary expander.

14. The method as recited in claim 2, wherein said step c) includes generating electrical power with said rotating device.

* * * * *